US006764868B1

(12) United States Patent
Oey Hewett et al.

(10) Patent No.: US 6,764,868 B1
(45) Date of Patent: Jul. 20, 2004

(54) USE OF SLURRY WASTE COMPOSITION TO DETERMINE THE AMOUNT OF METAL REMOVED DURING CHEMICAL MECHANICAL POLISHING, AND SYSTEM FOR ACCOMPLISHING SAME

(75) Inventors: Joyce S. Oey Hewett, Austin, TX (US); Alexander J. Pasadyn, Austin, TX (US)

(73) Assignee: Advanced Micro Devices, Inc., Austin, TX (US)

( * ) Notice: Subject to any disclaimer, the term of this patent is extended or adjusted under 35 U.S.C. 154(b) by 207 days.

(21) Appl. No.: 09/909,112

(22) Filed: Jul. 19, 2001

(51) Int. Cl.[7] ..... H01L 21/66; H01L 21/302
(52) U.S. Cl. ..... 438/14; 438/692; 216/84
(58) Field of Search ..... 438/15, 692; 216/84

(56) References Cited

U.S. PATENT DOCUMENTS 5,399,234 A * 3/1995 Yu et al. ..... 156/636
5,637,185 A * 6/1997 Murarka et al. ..... 438/5
5,876,266 A * 3/1999 Miller et al. ..... 451/36
6,379,538 B1 * 4/2002 Corlett et al. ..... 210/96.1

* cited by examiner

*Primary Examiner*—Nadine G. Norton
*Assistant Examiner*—Lynette T. Umez-Eronini

(74) *Attorney, Agent, or Firm*—Williams, Morgan & Amerson, P.C.

(57) ABSTRACT

In general, the present invention is directed to a method of using slurry waste composition to determine the amount of metal removed during chemical mechanical polishing processes, and a system for accomplishing same. In one embodiment, the method comprises providing a substrate having a metal layer formed thereabove, performing a chemical mechanical polishing process on the layer of metal in the presence of a polishing slurry, measuring at least a concentration of a material comprising the metal layer in the polishing slurry used during said polishing process after at least some of said polishing process has been performed, and determining a thickness of the layer of metal removed during the polishing process based upon at least the measured concentration of the material comprising the metal layer. In another embodiment, the present invention is directed to a system that is comprised of a chemical mechanical polishing tool for performing a chemical mechanical polishing process on a metal layer in the presence of a polishing slurry, a concentration monitor for measuring a concentration of a material comprising the metal layer in the polishing slurry after at least one of the polishing process has been performed, and a controller for receiving the measured concentration and determining a thickness of the layer of metal removed during the polishing process based upon at least the measured concentration of the material comprising the layer of metal.

24 Claims, 2 Drawing Sheets

USE OF SLURRY WASTE COMPOSITION TO DETERMINE THE AMOUNT OF METAL REMOVED DURING CHEMICAL MECHANICAL POLISHING, AND SYSTEM FOR ACCOMPLISHING SAME

BACKGROUND OF THE INVENTION

1. Field of the Invention

The present invention is generally directed to the field of semiconductor manufacturing, and, more particularly, to the use of slurry waste composition to determine the amount of metal removed during chemical mechanical polishing, and a system for accomplishing same.

2. Description of the Related Art

There is a constant drive within the semiconductor industry to increase the operating speed of integrated circuit devices, e.g., microprocessors, memory devices, and the like. This drive is fueled by consumer demands for computers and electronic devices that operate at increasingly greater speeds. This demand for increased speed has resulted in a continual reduction in the size of semiconductor devices, e.g., transistors. That is, many components of a typical field effect transistor (FET), e.g., channel length, junction depths, gate insulation thickness, and the like, are reduced. For example, all other things being equal, the smaller the channel length of the transistor, the faster the transistor will operate. Thus, there is a constant drive to reduce the size, or scale, of the components of a typical transistor to increase the overall speed of the transistor, as well as integrated circuit devices incorporating such transistors.

In modern integrated circuit devices, millions of transistors are formed above a surface of a semiconducting substrate. To perform their intended functions, these transistors, or groups of transistors, are electrically coupled together by many levels of conductive interconnections, i.e., conductive metal lines and plugs. These conductive lines and plugs allow electrical signals to propagate throughout the integrated circuit device. In general, these conductive interconnections are formed in layers of insulating material, e.g., silicon dioxide, HSQ, or other materials that may have a dielectric constant less than approximately 5.0. The insulating materials electrically isolate the various conductive interconnections and tend to reduce capacitive coupling between adjacent metal lines when the integrated circuit device is in operation.

As the demand for high performance integrated circuit devices continues to increase, circuit designers and manufacturers look for ways to improve device performance. Recently, copper has become the material of choice for conductive interconnections for high performance integrated circuit devices, e.g., microprocessors, due to its lower resistance as compared to, for example, aluminum.

Conductive interconnections comprised of copper may be formed using a variety of process flows, e.g., single damascene, dual damascene, etc. For example, a layer of insulating material may be formed on or above a semiconducting substrate. Thereafter, a plurality of openings may be formed in the layer of insulating material using known photolithographic and etching techniques. Then, a relatively thin barrier metal layer comprised of, for example, tantalum, is conformally deposited above the insulating layer and in the openings in the insulating layer. Next, a relatively thin layer of copper, a so-called copper seed layer, is deposited on the barrier metal layer. A much thicker layer of copper is then formed by using known electroplating techniques. This final layer of copper will fill the remaining portions of the openings in the insulating layer, and have an upper surface that extends above the surface of the insulating layer.

Ultimately, one or more chemical mechanical polishing (CMP) operations will be performed to remove the excess copper and barrier layer material from above the surface of the insulating layer. This process results in the definition of a plurality of conductive interconnections, e.g., conductive lines or plugs, or a combination of both, positioned within the openings in the insulating layer.

As set forth above, chemical mechanical polishing is an important process as it relates to the formation of conductive interconnections comprised of copper in modern integrated circuit devices. A variety of chemical mechanical polishing tools are commercially available. In all such systems, the object is to polish the surface of a process layer, e.g., copper, with a polishing pad in the presence of a polishing slurry. In general, chemical mechanical polishing involves the selective removal of all or portions of the process layer or film from the wafer through chemical reactivity of the polishing slurry used during the process, and the mechanical abrasion of the process layer due to its contact with the polishing pad. For example, the chemical component of the CMP process is dependent on the chemistry, concentration and pH of the polishing slurry. Furthermore, the mechanical abrasion is dependent on, among other things, the slurry particle size and concentration, polishing pad hardness and surface roughness, pad pressure, and the rotational speeds of the wafer and the pad. All of these variables tend to make accurately controlling CMP prossesses difficult.

During the course of forming conductive interconnections using a CMP process, it may be important to be able to determine the amount of metal, e.g., copper, removed. More particularly, it may be important to determine the thickness of the layer removed during the CMP process. The ability to accurately determine this information may assist in enhancing process yield and accurately controlling and terminating CMP processes.

The present invention is directed to a method that may solve, or at least reduce, some or all of the aforementioned problems.

SUMMARY OF THE INVENTION

In general, the present invention is directed to a method of using slurry waste composition to determine the amount of metal removed during chemical mechanical polishing processes, and a system for accomplishing same. In one embodiment, the method comprises providing a substrate having a metal layer formed thereabove, performing a chemical mechanical polishing process on the layer of metal in the presence of a polishing slurry, measuring at least a concentration of a material comprising the metal layer in the polishing slurry used during said polishing process after at least some of said polishing process has been performed, and determining a thickness of the layer of metal removed during the polishing process based upon at least the measured concentration of the material comprising the metal layer. In one illustrative embodiment, the determination of the thickness of the layer removed is performed by accessing a database comprised of data correlating a measured concentration of a material in a volume of waste slurry to a removed thickness of the material. In other embodiments, the method comprises calculating the removed thickness of the material based upon at least the measured concentration of the process layer material in the waste slurry.

In another embodiment, the present invention is directed to a system that is comprised of a chemical mechanical polishing tool for performing a chemical mechanical polishing process on a metal layer in the presence of a polishing slurry, a concentration monitor for measuring a concentration of a material comprising the metal layer in the polishing slurry used during said polishing process after at least some of the polishing process has been performed, and a controller for receiving the measured concentration and determining a thickness of the layer of metal removed during the polishing process based upon at least the measured concentration of the material comprising the layer of metal.

BRIEF DESCRIPTION OF THE DRAWINGS

The invention may be understood by reference to the following description taken in conjunction with the accompanying drawings, in which like reference numerals identify like elements, and in which.

Figure 1:
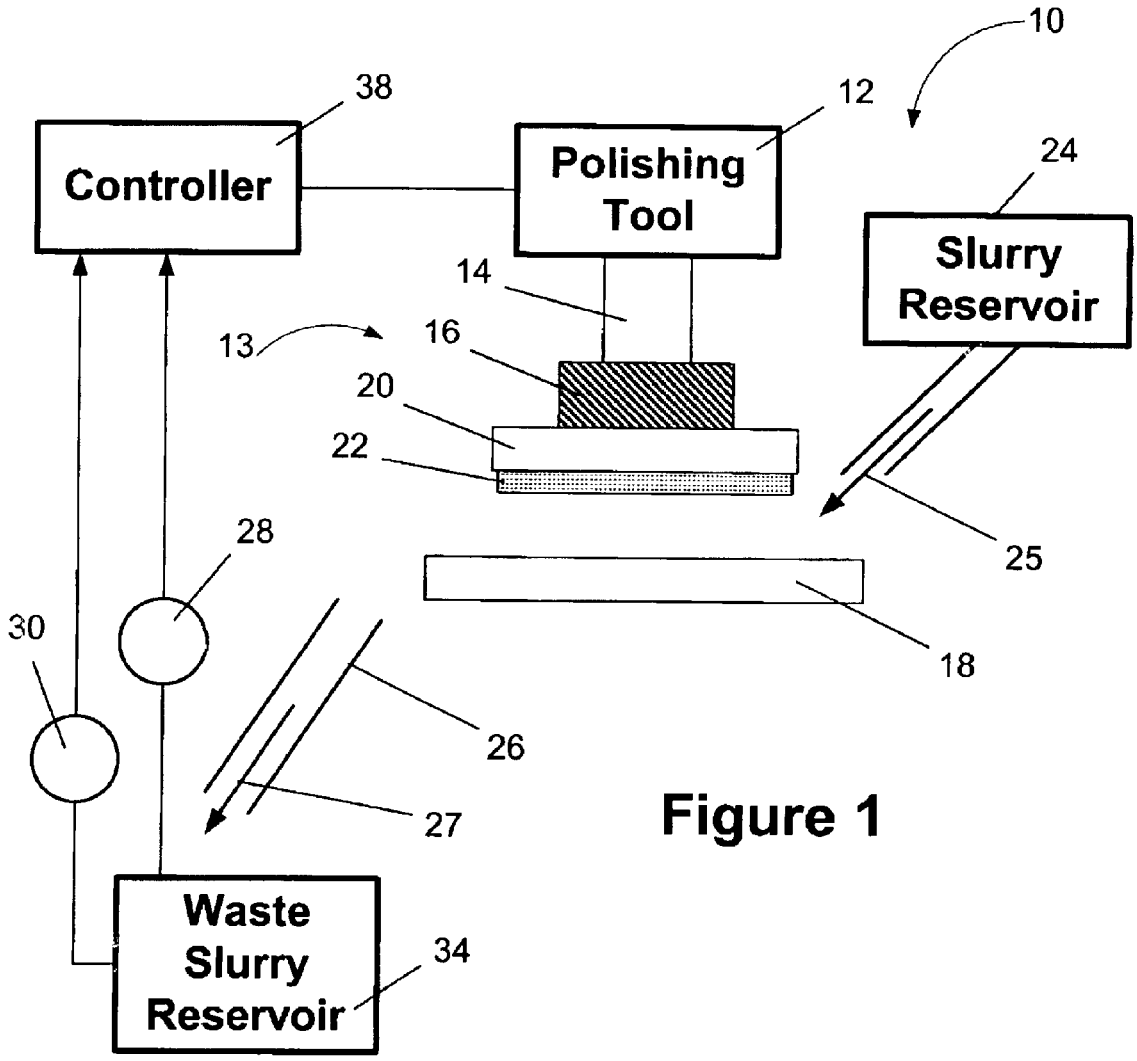
FIG. 1 is schematic diagram depicting an illustrative system in accordance with one illustrative embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached figures. The various systems and equipment are depicted schematically in the drawings. However, those skilled in the art will recognize that, in reality, these systems and equipment may contain additional support facilities and components, e.g., motors, robotic arms, etc. Nevertheless, the attached drawings are included to describe and explain illustrative examples of the present invention.

In general, the present invention is directed to the use of slurry waste composition to determine the amount of metal removed during chemical mechanical polishing, and a system for accomplishing same. As will be readily apparent to those skilled in the art upon a complete reading of the present application, the present method is applicable to a variety of technologies, e.g., NMOS, PMOS, CMOS, etc., and it is readily applicable to a variety of devices, including, but not limited to, logic devices, memory devices, etc.

Chemical mechanical polishing systems may have a variety of configurations. Some chemical mechanical polishing tools may have multiple polishing heads and stations where multiple wafers may be polished at each station using the same polishing process. An example of such a chemical mechanical polishing tool is a multiple head polishing tool sold by SpeedFam—IPEC. Other polishing tools may have multiple polishing stations, and a single wafer may be processed through all of the stations to complete the process. For example, an Applied Materials Mirra polishing system has three polishing platens where various activities of an overall polishing process are performed. The present invention may be used with these types of polishing systems, as well as other types commonly found in semiconductor manufacturing operations. Thus, the present invention should not be considered as limited to any particular type of polishing tool or system unless such limitations are clearly set forth in the appended claims.

FIG. 1 depicts one illustrative embodiment of a system 10 in accordance with the present invention. As schematically depicted therein, the system 10 comprises a chemical mechanical polishing tool 12 comprised of a polishing arm 14, a carrier head 16 and a polishing pad 18. An illustrative wafer 20, having an illustrative layer of metal 22, e.g., copper, aluminum, tungsten, etc., formed thereon, is coupled to the carrier head 16 of the polishing tool 12. Also depicted in FIG. 1 is a slurry reservoir 24, a waste slurry outlet 26, a waste slurry reservoir 34, a concentration monitor 28, and a volume meter 30. The concentration monitor 28 and the volume meter 30 are in communication with a controller 38. The controller 38 is also in communication with the polishing tool 12. The slurry reservoir 24 contains a polishing slurry 25. Waste slurry 27, i.e., polishing slurry used during polishing operations, exits the polishing tool 12 at some point during the polishing process performed on the layer of metal 22 in the polishing tool 12.

As will be recognized by those skilled in the art after a complete reading of the present application, a polishing process will be performed on the metal layer 22 to remove at least a portion of the metal layer 22 from the wafer 20. During this process, polishing slurry 25 from the slurry reservoir 24 will be introduced at the interface of the metal layer 22 and the polishing pad 18 during the polishing process.

In one embodiment, during the polishing process, the polishing pad 18 and/or the wafer 20 will be rotated, typically in opposite directions, and a downforce will be applied by the polishing arm 14 to urge the metal layer 22 into engagement with the polishing pad 18. In addition, the wafer 20 may be oscillated back and forth across the polishing pad 18 as the polishing process is being performed. As stated previously, during this process, polishing slurry 25 is introduced from the slurry reservoir 24 and it is removed from the process via the waste slurry outlet 26 and deposited into the waste slurry reservoir 34. Ultimately, the waste slurry 27 may be filtered or otherwise treated and recycled to the slurry reservoir 24 for use in further polishing operations. The various components involved in this treating or filtering are not depicted in FIG. 1.

The various components of the system 10 schematically depicted in FIG. 1 may be any type of tool or component capable of performing the functions described herein. For example, the polishing tool 12 may be any type of tool capable of polishing or planarizing the metal layer 22 on the wafer 20. The polishing arm 14, carrier head 16 and polishing pad 18 are intended to be schematically representative of a polishing station 13 in any type of polishing system where polishing operations are performed. For example, the polishing station 13 is intended to be representative of a polishing station or platen on the aforementioned polishing systems sold by SpeedFam—IPEC and Applied Materials, despite physical differences between those polishing tools. Of course, the schematic depiction of the polishing tool 12 in FIG. 1 omits many features of the tool, e.g., power supply, motors, etc., for purposes of clarity. Any type of polishing slurry 25 and polishing pad 18 may be used with the present invention. Moreover, it should be noted that the present invention may be employed in polishing a single wafer 20 or multiple wafers 20.

The connection monitor 28 may be any type of instrumentation sufficient for determining the concentration of the material comprising the metal layer 22 in the waste slurry 27. Similarly, the volume meter 30 may be any type of instrumentation that provides information as to the volume of the waste slurry 27 in the waste slurry reservoir 34.

In the illustrated embodiment, the controller 38 is a computer programmed with software to implement the functions described herein. Moreover, the functions described for the controller 38 may be performed by one or more controllers spread throughout the system. For example, the controller 38 may be a fab level controller that is used to control processing operations throughout all or a portion of a semiconductor manufacturing facility. Alternatively, the controller 38 may be a lower level computer that controls only portions or cells of the manufacturing facility. Moreover, the controller 38 may be a stand-alone device, or it may reside on the polishing tool 10. However, as will be appreciated by those of ordinary skill in the art, a hardware controller (not shown) designed to implement the particular functions may also be used.

Portions of the invention and corresponding detailed description are presented in terms of software, or algorithms and symbolic representations of operations on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these similar terms are to be associated with the appropriate physical quantities and are merely convenient labels supplied to those quantities. Unless specifically stated otherwise, or as is apparent from the discussion, terms such as "processing" or "computing" or "calculating" or "determining" or "displaying" or the like, refer to the actions and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

An exemplary software system capable of being adapted to perform the functions of the controller 38, as described, is the Catalyst system offered by KLA Tencor, Inc. The Catalyst system uses Semiconductor Equipment and Materials International (SEMI) Computer Integrated Manufacturing (CIM) Framework compliant system technologies, and is based on the Advanced Process Control (APC) Framework. CIM (SEMI E81-0699—Provisional Specification for CIM Framework Domain Architecture) and APC (SEMI E93-0999—Provisional Specification for CIM Framework Advanced Process Control Component) specifications are publicly available from SEMI.

The operation of the system 10 will now be described. In general, the present invention is directed to determining the amount of the metal layer 22 removed during the polishing process based upon an analysis of the waste slurry 27 resulting from the process. The methods described herein may be used to determine the amount of the metal layer 22 removed at any point during the polishing process, or after the polishing process is believed to have been successfully completed. The methods described herein may be used for a variety of additional purposes, e.g., to adjust one or more parameters of the polishing processes performed on the metal layer 22 on subsequently polished wafers. For example, if the amount of copper removed indicates that too much copper was removed at an initial polishing station, the duration of the polishing operation performed at that station on subsequent wafers may be reduced.

In one embodiment, the present invention involves isolating the polishing station of a polishing tool such that waste slurry 27 from polishing operations performed on a single wafer or at a single station of a multi-station polishing tool will be collected in a unique slurry waste reservoir 34 for that particular polishing station, as shown in FIG. 1. That is, the polishing tool 12 may be configured such that the polishing slurry 25 used in polishing a metal layer 22 may be collected in a unique waste slurry reservoir 34. In some embodiments, a slurry reservoir 34 is provided for each polishing station of a multi-head polishing tool, or at each platen of the Applied Materials Mirra polisher. The waste slurry reservoir 34 is sized to be able to hold a known volume of waste slurry 27 used in polishing the metal layer 22. The concentration of the material comprising the metal layer 22 is the waste slurry 27 may be correlated with a thickness of metal removed from the metal layer 22. That is, increased concentration of the metal in the waste slurry 27 indicates that increasing amounts of the metal layer 22 have been removed.

The concentration of the material comprising the metal layer 22 and a known quantity of waste slurry 27 may be correlated to a thickness of the portion of the metal layer 22 removed during the process by calculation or by empirical testing. Having established this model, the removed thickness of the metal layer 22 removed during any portion of a polishing process may readily be determined. Moreover, if the thickness of the metal layer 22 is determined prior to beginning polishing operations, the present invention may be readily used to determine the remaining amount of the metal layer 22 to be removed. That is, the determined thickness of the layer removed during the polishing may be subtracted from the starting thickness of the metal layer 22.

In one illustrative embodiment, a correlation may be established between the removed thickness of a copper layer and the concentration of copper in a known volume of waste slurry. For example, for a known volume of waste slurry, varying amounts of a layer of copper may be removed, e.g,, 100 Å, 200 Å, 400 Å, etc., and the concentration of the copper in the known volume of waste slurry may be measured. The thickness of the layer removed may be measured using an ellipsometer. This process may be repeated many times to obtain stastically valid data. Thereafter, a correlation may be made of the removed thickness ($t_{removed}$) vs. copper concentration, and a plot or graph of this correlation may be made. This correlation of concentration versus removed thickness may be stored in the form of a database, i.e., a model. For example, assuming the relationship is linear, then the graph of such data may appear as follows:

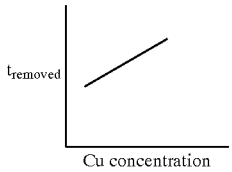

Of course, the relationship may be other than linear. After the correlation or model is developed, it may be used or accessed to determine the thickness of the copper removed based upon the measured concentration of the copper in the waste slurry.

This correlation of concentration versus removed thickness may be stored in a variety of forms, and it may be accessed as desired or when necessary. For example, the correlation data may be stored in a database or model. When desired, a controller, such as controller 38, may access the data to determine the thickness removed based upon the measured concentration of the material comprising the metal layer in the waste slurry.

In another illustrative embodiment, the present method may be used to determine the thickness of the metal layer 22 removed by the following equation:

$$t_{approved} = \frac{ACV}{D}$$

wherein:

$t_{removed}$=the thickness of the metal layer 22 removed;

D=the density of the material comprising the metal layer 22;

C=the measured concentration of the material comprising the metal layer 22;

V=the volume of the waste slurry; and

A=the surface area of the metal layer 22 being subjected to the polishing process.

For a given wafer size, e.g., 8-inch wafers, the surface area ("A") may be readily determined. Similarly, the density ("D") of the material comprising the metal layer 22 is generally known. The concentration of the material comprising the metal layer 22 may be readily measured by the concentration monitor 28. The volume of the waste slurry 27 in the waste slurry reservoir 34 may be determined by the volume meter 30. Alternatively, the waste slurry reservoir 34 may be sized so as to hold a certain, known volume of the waste slurry 27. In this situation, a full waste slurry reservoir 34 is representative of a known volume of waste slurry. Thus, by knowing the concentration of the material comprising the metal layer 22 and the volume of the waste slurry 27 used during the period under consideration, the removed thickness ($t_{removed}$) may be determined or calculated.

In some embodiments, the waste slurry reservoir 34 may be substantially emptied after every polishing process that is desired to be monitored is complete. Alternatively, the waste slurry reservoir 34 may be sufficiently large that multiple polishing processes may be performed before the volume of waste slurry 27 resident in the waste slurry reservoir 34 would require that the waste slurry reservoir 34 be emptied. In that situation, the volume meter 30 may be essentially "zeroed-out" after each polishing process desired to be monitored. Moreover, as a result of recycling the polishing slurry 25 and using it in polishing many wafers, the polishing slurry 25 in the slurry reservoir 24 will likely have a noticeable concentration of the material comprising the metal layer 22. In that case, another concentration monitor (not shown) may be provided to determine the concentration of the metal in the slurry 25 prior to performing a polishing operation. The concentration of the incoming slurry may be treated as a baseline value in determining the concentration of the metal in the waste slurry 27 due to polishing operations. Alternatively, the concentration monitor 28 on the wafer slurry reservoir 34 may be "zeroed-out" relative to this incoming concentration.

As set forth above, information as to the density (D) are area (A) of the metal layer 22 under consideration is supplied to or stored in the controller 38. Thereafter, the controller 38 is provided with input as to the concentration of the material comprising the metal layer 22 and the volume of the waste slurry 27. Using this information, the controller 38 then determines the removed thickness ($t_{removed}$) of the metal layer 22. The controller 38 may receive multiple data inputs as to the concentration of the material comprising the metal layer 22 and the volume of the waste slurry 27 at one or more times during the polishing process. Moreover, the data provided to the controller 38, e.g., concentration, volume, area, etc., may be statistically manipulated by the controller 38 as desired, e.g., the data may be averaged.

Once the removed thickness ($t_{removed}$) is determined, it may be used for a variety of purposes. For example, if the thickness of the metal layer 22 is known prior to beginning polishing operations, the amount of the remaining material, i.e., the material yet to be removed, may readily be determined by subtraction ($t_{original}-t_{removed}=t_{remaining}$).

Figure 2:
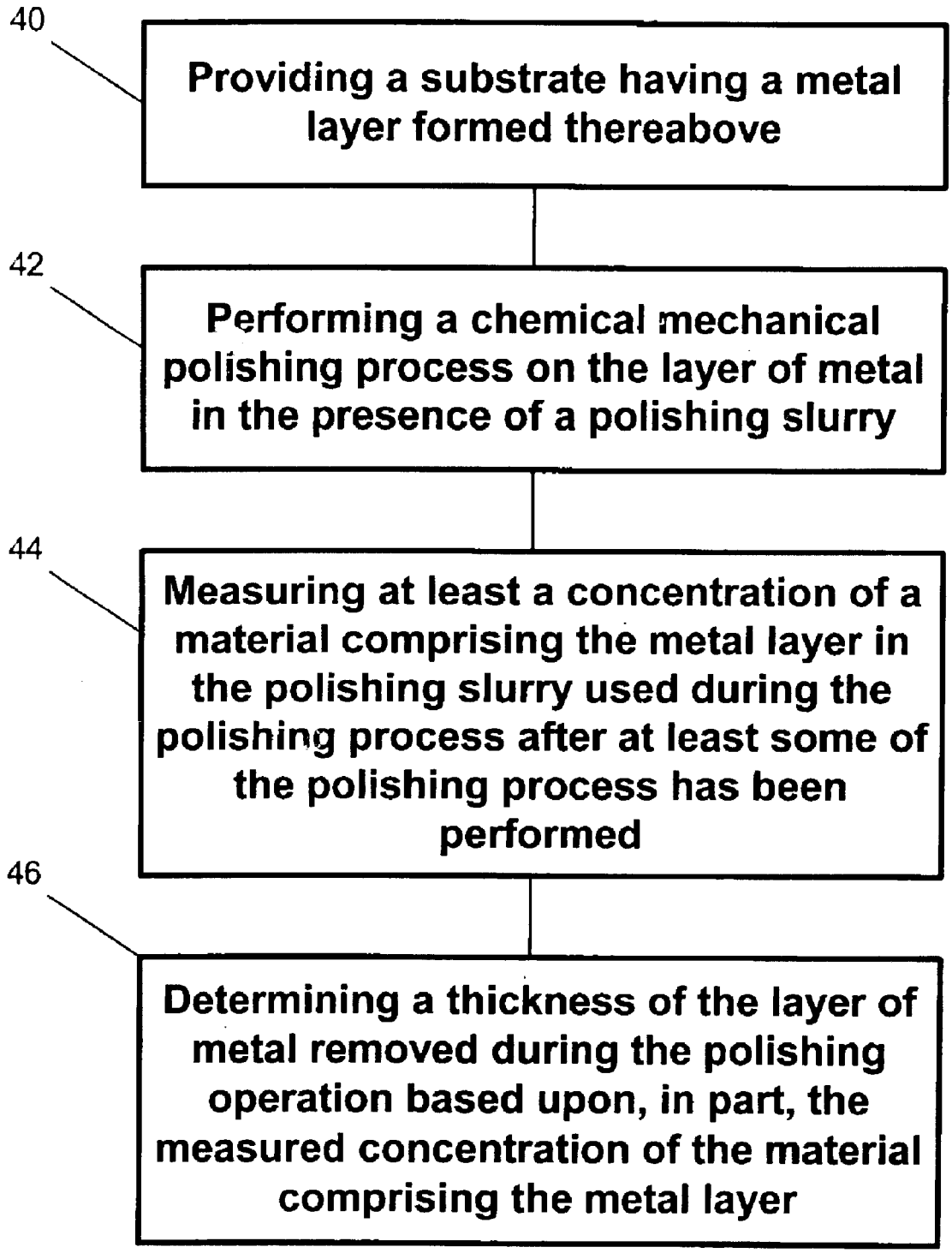
FIG. 2 is a flowchart depicting one illustrative embodiment of a method in accordance with the present invention.

In general, the present invention is directed to a method of using waste slurry composition to determine the amount of metal removed during chemical mechanical polishing processes, and a system for accomplishing same. In one embodiment, as set forth in FIG. 2, the method comprises providing a substrate 20 having a metal layer 22 formed thereabove, as recited at block 40, and performing a chemical mechanical polishing process on the layer of metal 22 in the presence of a polishing slurry 25, as described at block 42. The method further comprises measuring at least a concentration of a material comprising the metal layer 22 in the polishing slurry used during said polishing process after at least some of said polishing process has been performed, and determining a thickness of the layer of metal 22 removed during the polishing process based upon at least the measured concentration of the material comprising the metal layer, as set forth in block 46. As described previously, the removed thickness may be determined by calculation and/or by accessing a database correlating the measured concentration of the metal layer material in the waste slurry.

In another embodiment, the present invention is directed to a system that is comprised of a chemical mechanical polishing tool 12 for performing a chemical mechanical polishing operation on a metal layer 22 in the presence of a polishing slurry 25, a concentration monitor 28 for measuring a concentration of a material comprising the metal layer 22 in the polishing slurry 27 used during the polishing process after at least some of the polishing process has been performed, and a controller 38 for receiving the measured concentration and determining a thickness of the layer of metal 22 removed during the polishing process based upon at least the measured concentration of the material comprising the layer of metal 22. The system is also adapted to determine the removed thickness by calculation and/or accessing a previously established database.

In another illustrative embodiment, the present invention is directed to a system that is comprised of a means for performing a chemical mechanical polishing operation on a metal layer 22 in the presence of a polishing slurry 25, a means for measuring a concentration of a material comprising the metal layer 22 in the polishing slurry 27 used in the polishing process after at least some of the polishing process has been performed, and a controller means 38 for receiving the measured concentration and determining a thickness of the layer of metal 22 removed during the polishing process based upon at least the measured concentration of the material comprising the layer of metal 22. In the disclosed embodiment, the means for performing a chemical mechanical polishing process is one of a variety of chemical mechanical polishing tools commonly available on the market, such as those specifically identified in the present application. In the disclosed embodiment, the means for measuring the concentration of the material comprising the metal layer 22 is a concentration monitor, such as the one specifically identified in the present application.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method, comprising:

providing a substrate having a metal layer comprised of copper formed thereabove;

performing a chemical mechanical polishing process on said layer of metal in the presence of a polishing slurry;

measuring at least a concentration of copper in said polishing slurry used during said polishing process after at least some of said polishing process has been performed, wherein said polishing slurry used during said polishing process is collected in a waste slurry reservoir, and said step of measuring at least a concentration of copper is performed on said slurry in said waste slurry reservoir; and determining a thickness of said layer of metal removed during said polishing process based upon at least said measured concentration of copper.

2. The method of claim 1, further comprising adjusting at least one parameter of said polishing process based upon said calculated thickness of said layer of metal removed during said polishing process.

3. The method of claim 1, further comprising measuring a volume of said polishing slurry used during said polishing process.

4. The method of claim 3, further comprising calculating a thickness of said layer of metal removed during said polishing process based upon at least the measured volume of said polishing slurry used during said polishing operation.

5. The method of claim 3, further comprising calculating a thickness of said layer of metal removed during said polishing process based upon at least the measured volume of said polishing slurry used during said polishing operation and said measured concentration of said copper.

6. The method of claim 1, wherein measuring a concentration of copper comprises measuring a concentration of copper using a concentration monitor.

7. The method of claim 3, wherein measuring a volume of said polishing slurry used during said polishing process comprises measuring a volume of said polishing slurry used during said polishing process using a volumetric meter.

8. The method of claim 1, wherein said step of determining a thickness of said layer of metal removed during said polishing process comprises accessing a model comprised of data correlating said measured concentration of said material comprising said layer of metal and a thickness of a layer of material comprised of the same material as said layer of metal.

9. The method of claim 1, wherein said step of determining a thickness of said layer of metal removed during said polishing process comprises calculating a thickness of said layer of metal removed during said polishing process based upon at least said measured concentration.

10. A method, comprising:

providing a substrate having a metal layer comprised of copper formed thereabove;

performing a chemical mechanical polishing process on said layer of metal in the presence of a polishing slurry;

measuring at least a concentration of copper in said polishing slurry used during said polishing process after at least some of said polishing process has been performed, wherein said polishing slurry used during said polishing process is collected in a waste slurry reservoir, and said step of measuring at least a concentration of copper is performed on said slurry in said waste slurry reservoir; and calculating a thickness of said layer of metal removed during said polishing process based upon at least said measured concentration of copper.

11. The method of claim 10, further comprising adjusting at least one parameter of said polishing process based upon said calculated thickness of said layer of metal removed during said polishing process.

12. The method of claim 10, further comprising measuring a volume of said polishing slurry used during said polishing process.

13. The method of claim 12, further comprising calculating a thickness of said layer of metal removed during said polishing process based upon at least the measured volume of said polishing slurry used during said polishing operation.

14. The method of claim 12, further comprising calculating a thickness of said layer of metal removed during said polishing process based upon at least the measured volume of said polishing slurry used during said polishing operation and said measured concentration of copper.

15. The method of claim 10, wherein measuring a concentration of copper comprises measuring a concentration of copper using a concentration monitor.

16. The method of claim 12, wherein measuring a volume of said polishing slurry used during said polishing process comprises measuring a volume of said polishing slurry used during said polishing process using a volumetric meter.

17. A method, comprising:

providing a substrate having a metal layer comprised of copper formed thereabove;

performing a chemical mechanical polishing process on said layer of metal in the presence of a polishing slurry;

measuring at least a concentration of copper in said polishing slurry used during said polishing process after at least some of said polishing process has been performed, wherein said polishing slurry used during said polishing process is collected in a waste slurry reservoir, and said step of measuring at least a concentration of copper is performed on said slurry in said waste slurry reservoir; and determining a thickness of said layer of metal removed during said polishing process by accessing a model comprised of data correlating said measured concentration of copper and a thickness of a layer of copper.

18. The method of claim 17, further comprising adjusting at least one parameter of said polishing process based upon said determined thickness of said layer of metal removed during said polishing process.

19. The method of claim 17, wherein measuring a concentration of copper comprises measuring a concentration of copper using a concentration monitor.

20. A method, comprising:

providing a substrate having a metal layer comprised of copper formed thereabove;

performing a chemical mechanical polishing process on said layer of metal in the presence of a polishing slurry;

measuring a volume of said polishing slurry used during said polishing process after at least some of said polishing process has been performed;

measuring a concentration of copper in said measured volume of polishing slurry, wherein said polishing slurry used during said polishing process is collected in a waste slurry reservoir, and said step of measuring at least a concentration of copper and said step of measuring a volume of said polishing slurry is performed on said slurry in said waste slurry reservoir; and calculating a thickness of said layer of metal removed during said polishing process based upon at least said measured volume of polishing slurry and said measured concentration of copper.

21. The method of claim 20, further comprising adjusting at least one parameter of said polishing process based upon said calculated thickness of said layer of metal removed during said polishing process.

22. The method of claim 20, wherein measuring a volume of polishing slurry used during said polishing process comprises collecting said polishing slurry used during said polishing process in a reservoir having a known value.

23. The method of claim 20, wherein measuring a concentration of copper comprises measuring a concentration of copper using a concentration monitor.

24. The method of claim 20, wherein measuring a volume of said polishing slurry used during said polishing process comprises measuring a volume of said polishing slurry used during said polishing process using a volumetric meter.

* * * * *